United States Patent [19]

Porcheddu

[11] Patent Number: 4,819,945

[45] Date of Patent: Apr. 11, 1989

[54] WORD GAME

[76] Inventor: Edmond J. Porcheddu, 4439 Thoroughbred Dr., Roswell, Ga. 30075

[21] Appl. No.: 166,642

[22] Filed: Mar. 11, 1988

[51] Int. Cl.[4] ..... A63F 3/00

[52] U.S. Cl. ..... 273/272; 273/280; 273/282; 273/287

[58] Field of Search ..... 273/242, 272, 281, 282 B, 273/287, 288, 153 S

[56] References Cited

U.S. PATENT DOCUMENTS 1,578,554 3/1926 Seligman ..... 273/272
2,757,934 8/1956 Dunbar ..... 273/272

FOREIGN PATENT DOCUMENTS 1151 of 1882 United Kingdom ..... 273/282 B
435660 9/1935 United Kingdom ..... 273/153 S

OTHER PUBLICATIONS

WRDZ TM, Game Rules, Ed Porcheddu, Copyright 1987, 273-272.

*Primary Examiner*—Anton O. Oechsle
*Attorney, Agent, or Firm*—Hurt, Richardson, Garner, Todd & Cadenhead

[57] ABSTRACT

A novel word game is disclosed having a generally planar game board with an intersecting grid pattern formed therein. Playing pieces for the game are formed as individual tile members with a letter of the alphabet on the upper surface thereof and projections on the bottom surface thereof for engaging the grid pattern and facilitating movement of the tile members in a horizontal or transverse direction along the grid pattern for forming words or word portions.

8 Claims, 4 Drawing Sheets

10
12
14
16
18
20
22
24
26
28
30
32
34
36
38
40
41
42
44
46

WORD GAME

BACKGROUND OF THE INVENTION

This invention relates generally to a novel game board with cooperative playing pieces for playing a word game. Numerous word games which utilize a game board have been developed, most of which involve the utilization of lettered tiles or like members which are arranged by the players to form words for which points are awarded. The tiles are placed on the board in designated spaces, points being awarded for the length of the word, the values of the individual lettered tiles, and/or the location of the word or tiles on the board. Examples of games of this general type are found in U.S. Pat. No. 1,578,554, to Seligman, for a Game Apparatus, and in U.S. Pat. No. 2,757,934 to Dunbar, for a Game Board And Playing Pieces For Use With The Same.

SUMMARY OF THE INVENTION

It is, therefore, one of the principal objects of the present invention to provide a novel game board and playing pieces for a word game in which the pieces are positioned on the game board to form words or portions of words to obtain points, and which can be played by a plurality of persons with the turn rotating between players.

Another object of the present invention is to provide a novel word game in which the playing pieces may be moved horizontally and/or transversely relative to the game board without removing the pieces from the board to form different combinations within the prescribed rules of the game.

A further object of the present invention is to provide a novel word game, the playing of which is varied each time the game is played, and in which the board and playing pieces are easily constructed and maintained and which are durable for providing a long service life.

These and additional objects and advantages are attained by the present invention which relates to a novel game board and playing pieces for a word game having a grid-like game board which receives the playing pieces. The board and pieces are so constructed and arranged that adjacent tile members in place on the board can be easily slid horizontally or transversely along or across the grid pattern without lifting the members, to create new words or word portions as the game continues. The board generally includes a regular grid pattern. The playing pieces include a plurality of protrusion means which are received in the grid and when appropriately positioned, are slidable along or across the grid. Such movement, while facilitated by the design of the assembly, may or may not be desirable, this being part of the strategy of the game to be presently explained.

Various additional objects and advantages of the present invention will become apparent from the following detailed description, with reference to the accompanying drawings.

DETAILED DESCRIPTION OF THE PREFERRED EMBODIMENT

Figures 1, 2:
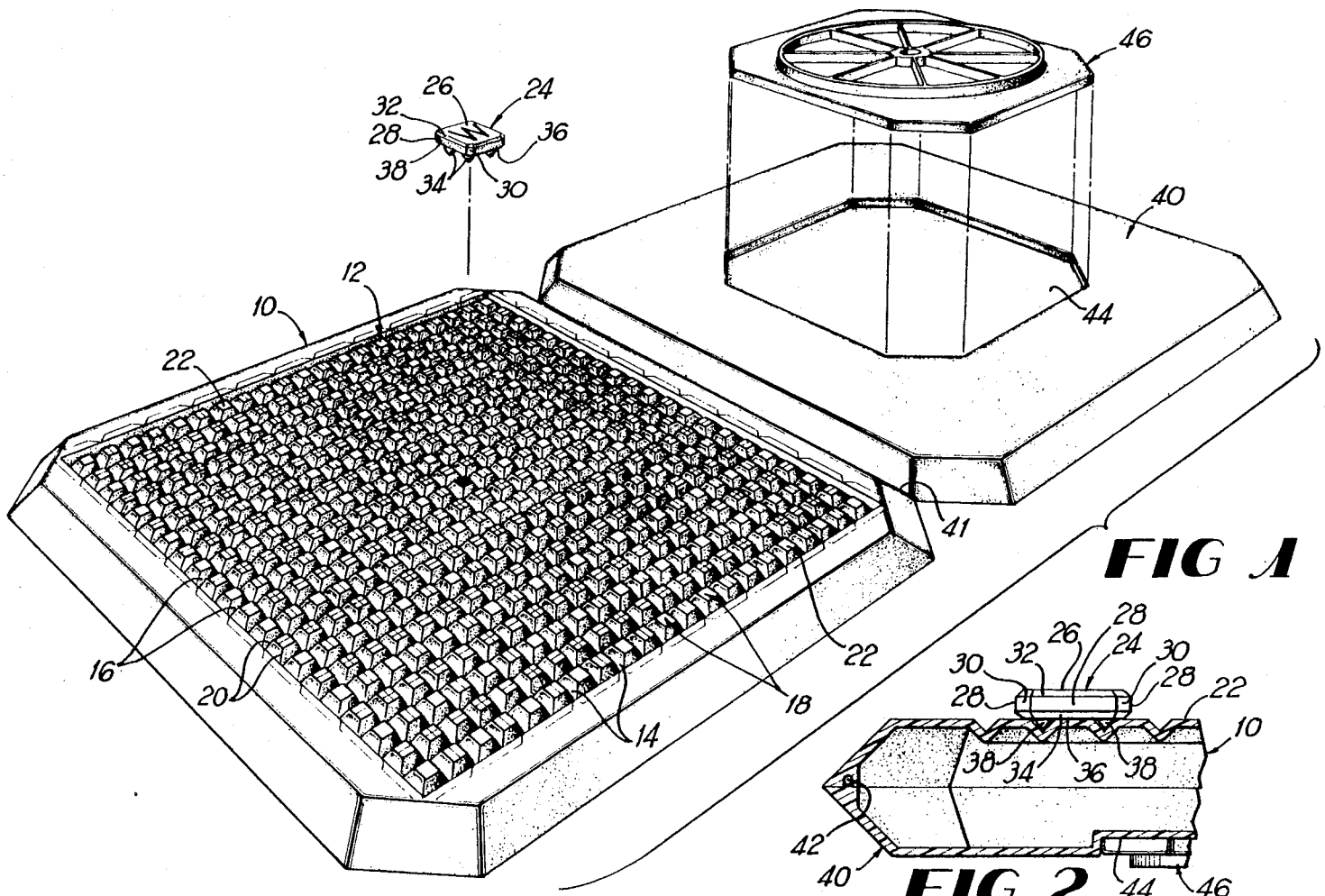
FIG. 1 is a perspective view of the game board, with a playing piece projected thereabove, and the base portion.
FIG. 2 is a cross-sectional view of the game board folded into playing or travel position.

Referring now more specifically to the drawings, and to FIG. 1 in particular, numeral 10 designates generally the game board, being of generally planar configuration. The board is constructed of wood, plastic, or another suitable material, as are the playing pieces used for the game. The playing surface 12 is defined by a plurality of horizontal, regularly spaced, parallel grooves 14 and a plurality of transverse, regularly spaced, parallel grooves 16. The grooves 14 and 16 are generally V-shaped and intersect one another at regular intervals, thereby effectively forming a plurality of raised block members 18.

As a result of the intersecting grooves, the corners 20 of the block members 18 extend angularly inwardly as they approach the top of the block members, the upper surfaces 22 of the block members being generally flattened and lying in the same plane. Thus, as can be seen from he drawings, the block members individually have a generally pyramidal shape and the configuration of the game board has a waffled appearance.

Figure 3:
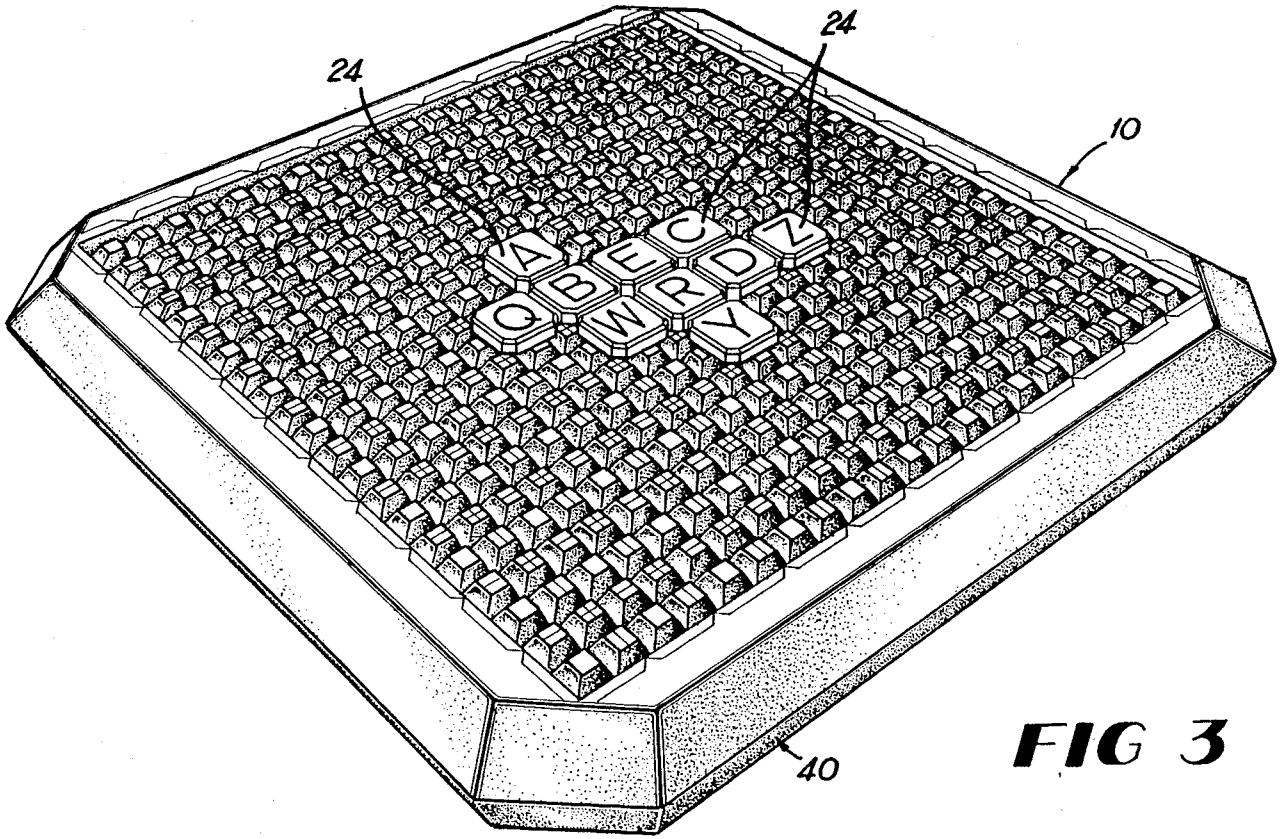
FIG. 3 is a perspective view of the game board and playing pieces as the game is being played.

At this point, it will be helpful to describe the playing pieces and their shape before beginning a description of how the game is played. The playing pieces have a generally squared or rectangular configuration and are formed as individual lettered tiles 24. The tiles have a single letter of the alphabet imprinted or embossed on the generally planar upper surface 26 thereof, which is used to form words or components of words. The sides 28 of these tile members are also substantially planar and vertically disposed with respect to the game board and perpendicular to the upper and lower surfaces of the tiles, so as to sit substantially flush with the side of an adjacent tile member, as shown in FIG. 3. The corners 30 of the tile members are beveled, creating a recess between the corners of adjacent tiles, so that if a row of tiles is slid horizontally or transversely during the playing of the game any adjacent tile members or rows of tile members are not disturbed. Similarly, there are additional beveled portions 32 on the tiles which connect the sides 28 and the corners 30 with the upper surface 26, and beveled portions 34 which connect the sides 28 and corners 30 with the bottom surface 36 of the tiles, thereby ensuring that the tiles do not engage or catch on the edges of the grooves when the tiles are slid therealong.

The tiles 24 also include a plurality of generally cone shaped or V-shaped projections 38 which project downwardly from the bottom surface 36 of the tiles for engaging the grooves 14 and 16 at selected intersection points thereof, depending on the placement of the tiles.

FIG. 1 also illustrates a base member 40 having the same general configuration as the game board, the base being hinged to the board with a live hinge 41, the board 10 and base member 40 being integrally joined. A locking member such as clasp 42, secures the board 10 and base member 40 together. The base portion has a centralized recess 44 formed therein which receives a rotatable turntable means 46 for turning the board around so that each player can view the board with the lettered tiles in a normal position relative to that player; i.e. so that the players do not have to study the board from the side or with the letters inverted during play.

Figure 4:
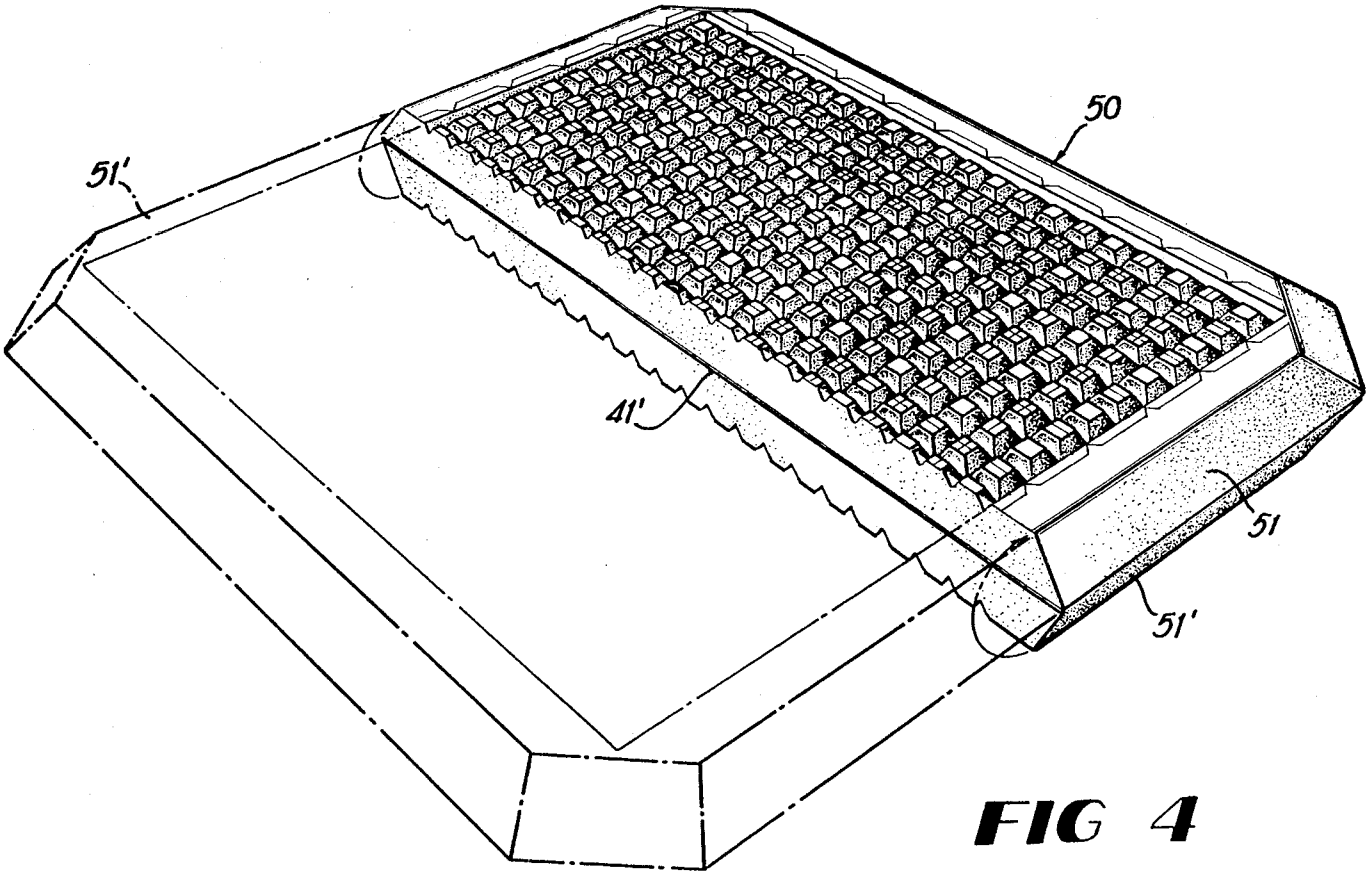
FIG. 4 is a perspective view of an alternate embodiment of the game board.

The remaining figures will now be described before the discussion of the method of play is begun. FIG. 3 illustrates several tile members 24 in place on the board 10 during the playing of the game. FIG. 4 illustrates an alternate embodiment of the game board, primarily designed as a travel version. Here, the board 50 is segmented into two halves 51 and 51', joined by an integral live hinge 41'. A clasp (not shown), similar to that shown in FIG. 2, is provided to secure the halves in folded position. The tile members are stored between the folded halves. As is evident from the drawing, unfolding the board provides a mated playing surface, identical to that shown in FIGS. 1 and 3.

Figure 5:
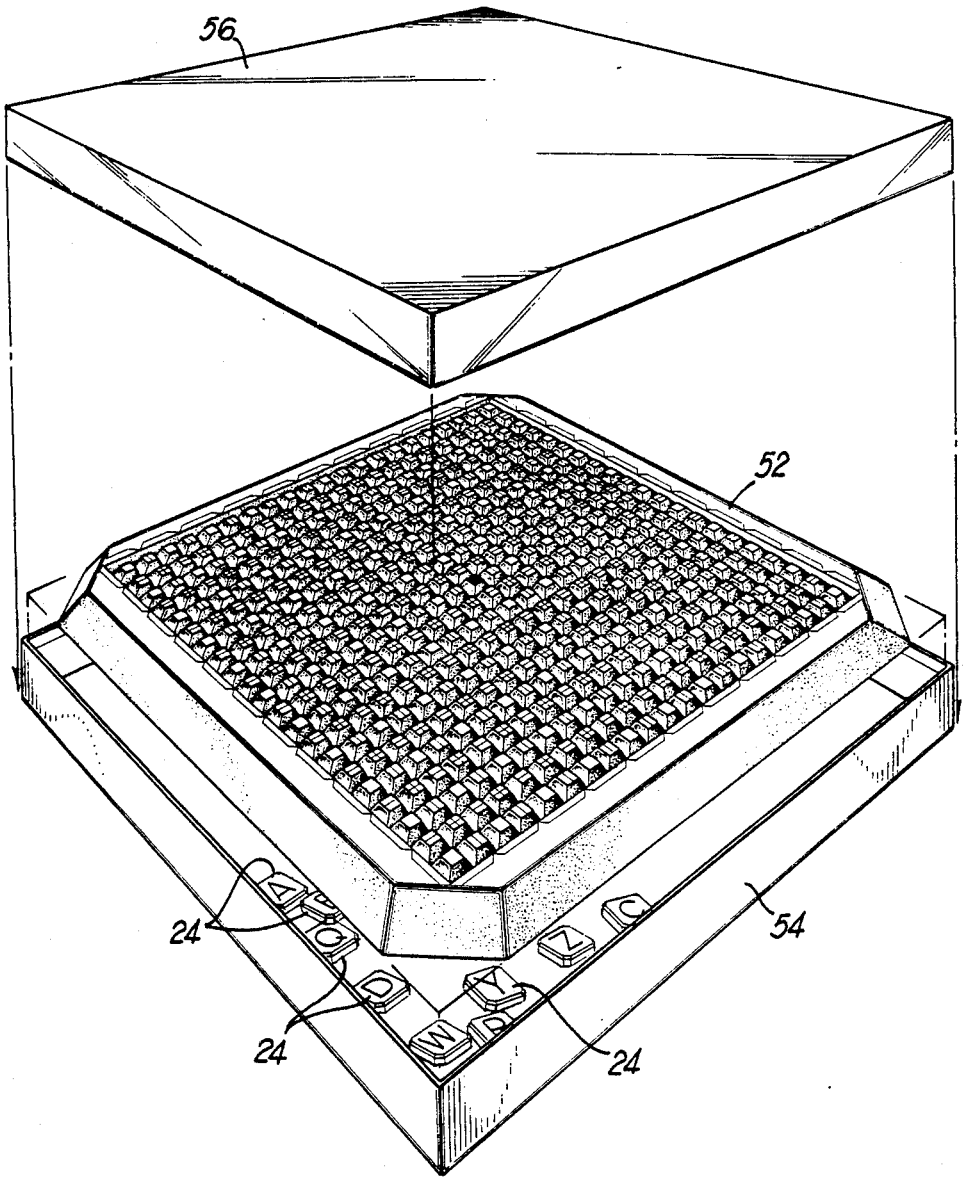
FIG. 5 is a perspective view of the game board with a box being shown in phantom lines exploded away from the board.

FIG. 5 illustrates a vacuum-molded game board 52, and in phantom lines, a storage box bottom portion 54 for receiving the board and the tile members 24. The top portion 56 of the box is also illustrated in phantom lines.

The discussion will now focus on the playing of the game, referring primarily to FIG. 3. A word in the game is a group of two or more letters which make up a word or part of a word. Words can be created by adding letters to the board either before, after, or between tiles which are in place on the board. The relative order of the letters, however, can not be changed, thus tiles can not be picked up once placed on the board and re-placed in a different position. A selected dictionary is normally used as a reference for determining the validity of a word. Proper names, city or country names, etc., may be considered valid by agreement of the players before the game begins. Hyphenated words are normally not allowed, since the tile members will normally contain only a single letter and not a hyphen, although such tiles can be provided.

Play begins with each player choosing a tile, which are all disposed face down or in a sack or the like to conceal their identity. The player closest to the letter "A" begins play by placing the tile in the center of the board and then choosing another tile. The second player then places a tile above, below, on either side, or in the space occupied by any resident tile by sliding the tile horizontally or transversely. The second player earns one point for each tile in the new word or word portion created, provided that the word or word portion is a valid word. Other players are permitted to challenge the validity of the word by an appropriate statement prior to the next player's turn.

With the tiles shown in FIG. 3, for example, placing a "V" above the "E" tile creates the word "VERY" and the word portion "AV", which might eventually become "AVIARY" or "HAVE" among others. Placement of the "V" would thus earn the player 6 points, one for each tile in the word and in any word portions created. An example of a move that might be challenged would be the placement of a "Z" between the "Q" and the "B" since it is highly unlikely that a valid word could be created from the sequence "Q Z B E C". (It is also highly unlikely that a player would make such a move, however, it serves as a good example.) If a player is challenged and loses, the challenging player receives all the points totaled for the challenged player's move, and the tile is removed. if the challenging player loses, the number of points scored is added to the challenged player's score as usual and the challenging player must subtract the same number of points from their accumulated score.

Thus, the players will normally have a valid word in mind or will be working toward building a valid word, since a challenged move must be justified by the possibility, however remote, that a word can eventually be created. The lack of sufficient spaces left in a row on the board does not matter, as long as a valid word is possible were more rows available. As more tiles are placed on the board, the number of points available increases. Thus, in the sequence shown in FIG. 3, adding a letter "A" above the "Q" and next to the "A" would earn 4 points, one for each letter in "AQ" and "AA". Adding a letter "A" after the "C", however, would earn 7 points, one for each letter in "QBECA" and "AZ", provided of course, that a valid word could eventually be completed from each sequence. As noted, the tile members 24 are designed to be slid horizontally and transversely without disturbing tile members in adjacent rows. Thus, a lettered tile, "M" for example could be disposed in the space occupied by the "Q" tile, sliding the four resident tiles transversely and creating the word portions "MQBEC," "AQW", "BRY", "ED", and "CZ". This move would thus account for 15 points, provided all the words or portions thereof are valid and can be proven thusly in the event of a challenge.

Each player has only one tile in their possession at any one time and, if stymied, may forfeit their turn by exchanging the tile for a different one, or by placing the tile on the board and hoping that the move is not challenged. If no one challenges the move, the move stands, regardless of whether or not the word or word portion created is valid according to the reference work used.

Play continues in such fashion until all of the tiles have been used, the winner being the player with the most total points. Individual moves may be timed as desired with a suitable timing device. Thus, timing, imagination, and bluffing all become part of the strategy of the game, which changes each time it is played.

While a preferred embodiment of a novel game board and playing pieces for a word game and modification thereof have been shown and described in detail herein, various additional changes and modifications thereof may be made without departing from the scope of the present invention.

I claim:

1. A word game comprising a game board having a generally planar configuration with a plurality of groove means formed therein, a first set of said groove means extending in a first direction and a second set of said groove means extending transversely relative to said first set in perpendicular relation thereto for delineating rectangular block members, said groove means being generally V-shaped so as to diverge outwardly on each side from the bottom of said groove means toward the top portion of said block members, and playing pieces for said word game being of generally rectangular configuration and having a letter of the alphabet on the upper facing surface thereof, said pieces also including a plurality of projections extending downwardly from the lower facing surface thereof for engaging said groove means.

2. A word game as defined in claim 1 wherein said playing pieces are formed as tile members having generally planar side, top and bottom surfaces with beveled portions connecting said side surfaces with said top and bottom surfaces for avoiding contact between corners of said tile members when placed in adjacent relationship on said game board.

3. A word game as defined in claim 2 in which said block members have generally planar upper surfaces for receiving said bottom surfaces of said tile members.

4. A word game as defined in claim 1 in which said first and second sets of groove means intersect one another at regular intervals, being wider at said intersections than in said V-shaped portions.

5. A word game as defined in claim 4 in which said projections on said tile members have a generally cone shaped configuration and are equally spaced near the edges of said playing pieces for engaging said intersections and facilitating movement in either horizontal or transverse direction on said game board.

6. A word game comprising a game board of generally planar configuration and having a grid pattern formed therein defined by a plurality of regularly spaced horizontal and transverse groove means intersecting at regular intervals, said groove means having upwardly diverging side walls being wider at the intersections thereof, and a plurality of playing pieces for said game of generally rectangular configuration having generally planar top and bottom surfaces with a letter of the alphabet on said top surface and a plurality of projections depending downwardly from said bottom surface for engaging said groove means so as to enable said pieces to be moved horizontally and transversely along said grid pattern.

7. A word game as defined in claim 6 in which said playing pieces include planar side portions disposed perpendicularly with respect to said top and bottom surfaces and beveled upper and lower edge portions connecting said side portions with said top and bottom surfaces, respectively, and the corners of said pieces being beveled for spacing the corners of said top and bottom surfaces when said pieces are disposed adjacent one another on said game board.

8. A word game as defined in claim 7 in which said projections on said playing pieces have a generally rounded configuration for facilitating movement along said groove means and through said intersections of said groove means.

* * * * *